US007063384B2

(12) United States Patent
Liu

(10) Patent No.: US 7,063,384 B2
(45) Date of Patent: Jun. 20, 2006

(54) FLEXIBLE CHAIR BACK

(76) Inventor: Huang Chang Liu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/753,749

(22) Filed: Jan. 9, 2004

(65) Prior Publication Data

US 2005/0151400 A1 Jul. 14, 2005

(51) Int. Cl.
*A47C 3/025* (2006.01)

(52) U.S. Cl. ..... 297/284.4; 297/291; 297/292; 297/293; 297/285

(58) Field of Classification Search ..... 297/284.4, 297/301.4, 314, 301.1, 285, 291, 292, 293, 297/284.1, 354.11, 216.13; 267/178, 179, 267/169

See application file for complete search history.

(56) References Cited

U.S. PATENT DOCUMENTS 1,663,898 A * 3/1928 Bitzenburger ..... 297/301.4
1,744,258 A * 1/1930 Bitzenburger ..... 297/301.4
1,951,674 A * 3/1934 Saunders ..... 297/301.4
2,008,392 A * 7/1935 Heller ..... 297/301.4
2,303,036 A * 11/1942 Flint ..... 297/301.4
2,602,489 A * 7/1952 Holten ..... 297/301.4
2,620,861 A * 12/1952 Oothoudt ..... 297/301.4
4,830,345 A * 5/1989 Mar ..... 267/133
4,892,356 A * 1/1990 Pittman et al. ..... 297/452.15
5,660,438 A * 8/1997 Tedesco ..... 297/284.6
5,711,575 A * 1/1998 Hand et al. ..... 297/284.6
5,909,926 A * 6/1999 Gonzalez ..... 297/354.12
5,913,568 A * 6/1999 Brightbill et al. ..... 297/258.1
6,092,871 A * 7/2000 Beaulieu ..... 297/284.4
6,257,665 B1 * 7/2001 Nagamitsu et al. ..... 297/285
6,419,318 B1 * 7/2002 Albright ..... 297/284.7

* cited by examiner

*Primary Examiner*—Peter M. Cuomo
*Assistant Examiner*—Erika Garrett

(57) ABSTRACT

A flexible chair back provides a preferred elastic effect than conventional plastic chair backs, which comprises a back supporting board having a flexible member integrally extended from the back supporting board, a rear board and a spring sandwiched by the back supporting board and the rear board. The spring enhances the elasticity of the flexible member, so that the flexible member pushes a seated person's back quite adaptively, and therefore a person can sit against the chair back with comfort for a long period of time.

1 Claim, 7 Drawing Sheets

FLEXIBLE CHAIR BACK

FIELD OF THE INVENTION

The present invention relates to flexible chair backs, and more particularly to a flexible chair back which comprises a back supporting board, a rear board and a spring. The flexible chair back provides a flexible and adaptive supporting mechanism for a person's back seating thereon, which is structurally simple and easy to be assembled. The elasticity is further enhanced by the spring; thereby the chair back can be made of thinner and softer material. The flexible chair back can be connected to a chair seat to form a chair, or it can be leaned on the chair back of a regular seat.

BACKGROUND OF THE INVENTION

As shown in FIG. 1, a plastic chair made by injection molding of the prior art comprises a back 12, a seat 11 and a plurality of legs. Though it is easy and cheap to manufacture, the chair has the following disadvantages. Firstly, since the flexibility of the back is poor, it is not comfortable to sit on for a long period of time. Secondly, the chair is not ventilative enough, since too many ventilating holes are not allowed due to structure-strength consideration.

SUMMARY OF THE INVENTION

Accordingly, the primary object of the present invention is to provide a comfortable chair back by which a seated person's back is elastically supported and is automatically pushed as the person's back is moving apart form the chair back slightly.

The secondary objective of the present invention is to provide a flexible chair back wherein a spring means is utilized to enhance the elasticity of the flexible chair back, so that the plastic material making the back supporting portion can be thin and soft. The spring means further provides a better restoring effect as the back supporting portion is twisted to one side caused by a seated person twisting his/her back.

The third objective of the present invention is to provide a ventilative chair back wherein the back supporting portion is provided with a hollow space and a flexible member integrally extending from the upper side of the hollow space. Thereby, the gap over the hollow space which is uncovered by the flexible member provides the necessary ventilative effect.

The various objects and advantages of the present invention will be more readily understood from the following detailed description when read in conjunction with the appended drawings.

DETAILED DESCRIPTION OF THE PREFERRED EMBODIMENTS

Figure 1:
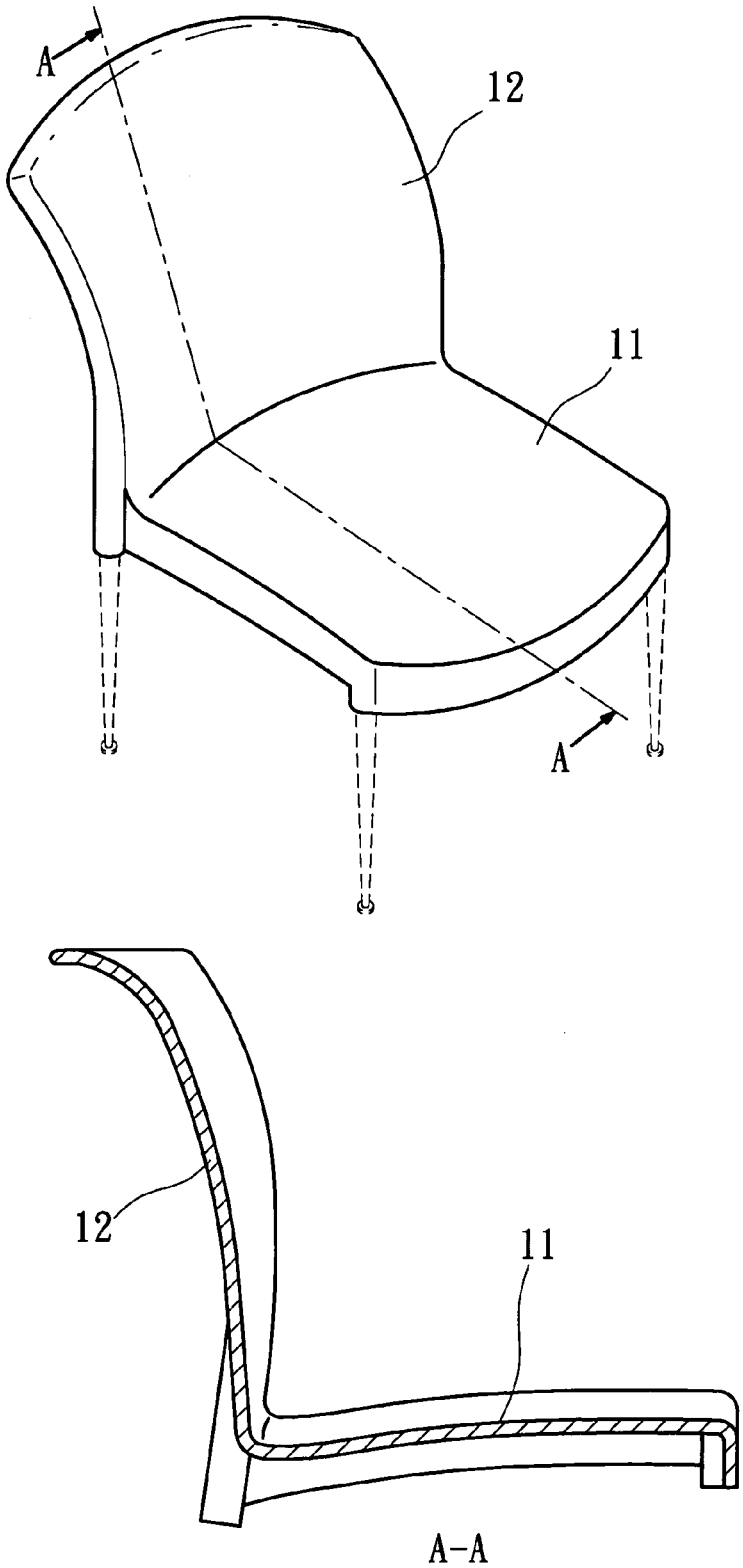
FIG. 1 contains respectively a perspective view and a cross-sectional view of a plastic injection molded chair of the prior art.
Figure 2:
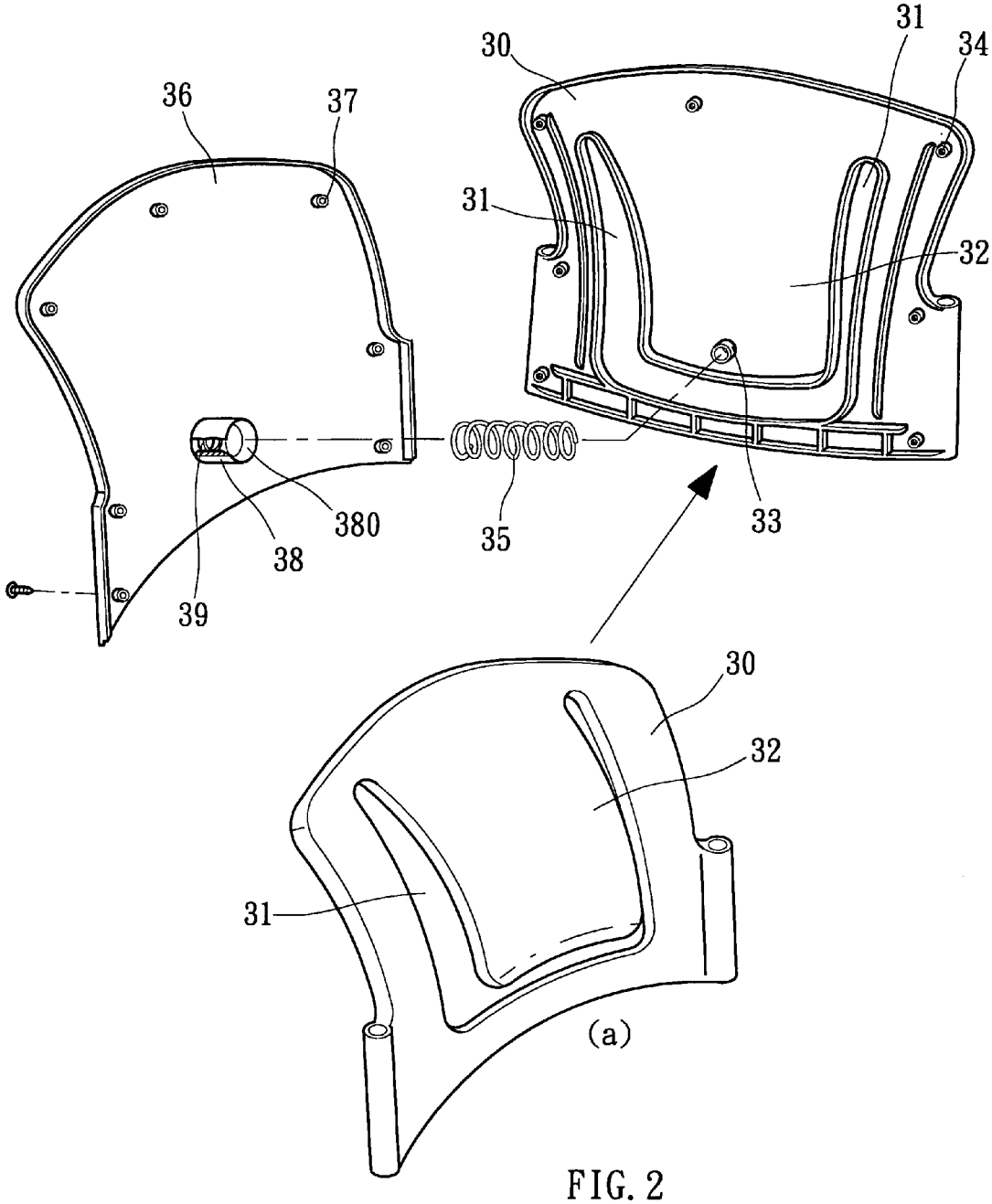
FIG. 2 contains respectively an exploded perspective view and a cross-sectional view of a flexible chair back according to the present invention.
Figure 3:
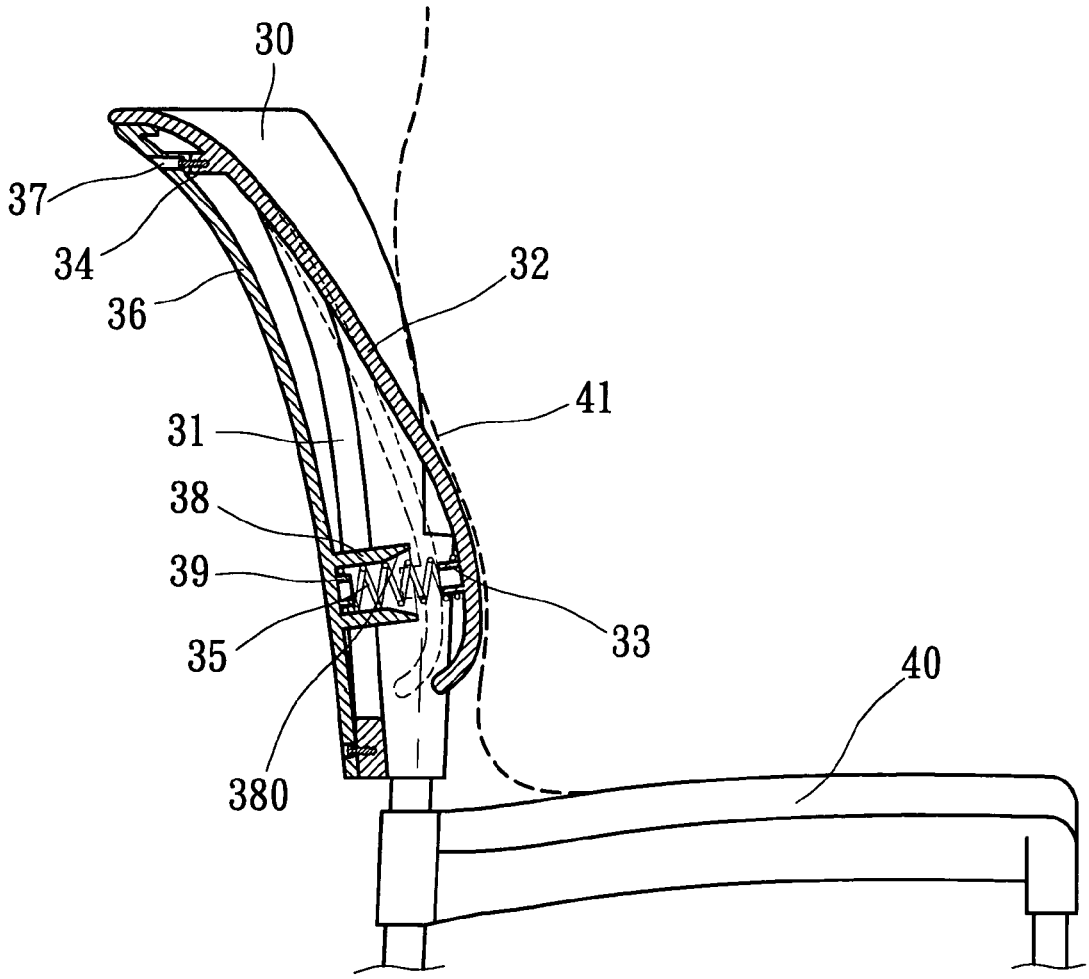
FIG. 3 is lateral cross-sectional view of the present invention.
Figure 4:
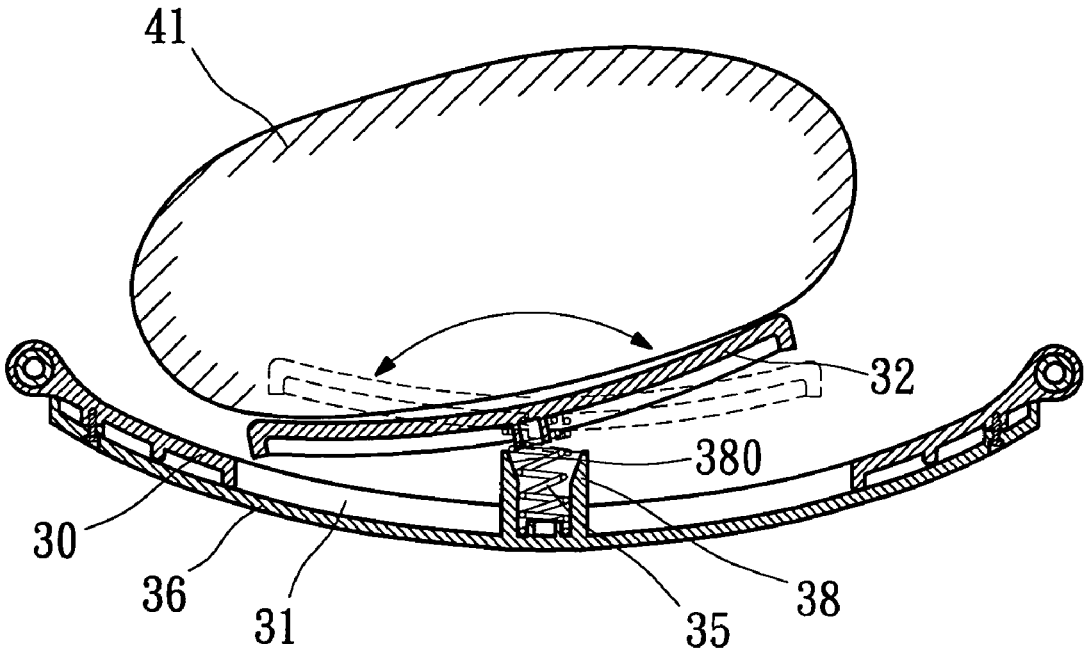
FIG. 4 is top cross-sectional view of the present invention wherein the flexible member is twisted by a seated person's back.

Referring to FIGS. 2, 3 and 4, a flexible chair back according to the present invention comprises a back supporting board 30, a rear board 36 and a spring 35. The back supporting board 30 is made of plastic material, and is provided with a hollow space 31 and a flexible member 32 integrally extending from the upper side of the hollow space 31. For supporting a seated person's back, the flexible member 32 is tilted slightly outwardly from a plane defined by the hollow space 31. The flexible member is further provided with a retaining post 33 on the inner side thereof. The rear board 36 is connected to the inner side of the back supporting board 30 to form a chair back. The back supporting board 30 is provided with a plurality of screw through holes 34 around the circumference thereof, and the rear board 36 is provided with a plurality of corresponding screw retaining holes 37. Thereby, the back supporting board 30 can be screw connected with the rear board 36. The rear board 36 has a retaining sleeve 38 of substantially cylindrical shape formed on the inner side thereof. The opening of the retaining sleeve 38 is provided with an inwardly inclined inner rim 380 for preventing the spring getting stuck by the retaining sleeve 38 caused by torsional bending of the flexible member 32. The retaining sleeve 38 is further provided with a lateral flange 39 for retaining the spring 35 more stably. The spring 35 is sandwiched by the flexible member 32 of the back supporting board 30 and the rear board 36, having one end housed in the retaining sleeve 38 and another end mounted on the retaining post 33.

To assemble the present invention, one end of the spring 35 is inserted into the retaining sleeve 38 of the rear board 36. The back supporting board 30 is then attached onto the rear board 36 so that the retaining post 33 of the back supporting board 30 penetrates into the other end of the spring 35. The rear board 36 and the back supporting board 30 are then locked together by screws. Therefore, the assembly of the present invention as a flexible chair back is easy and fast.

Figure 5:
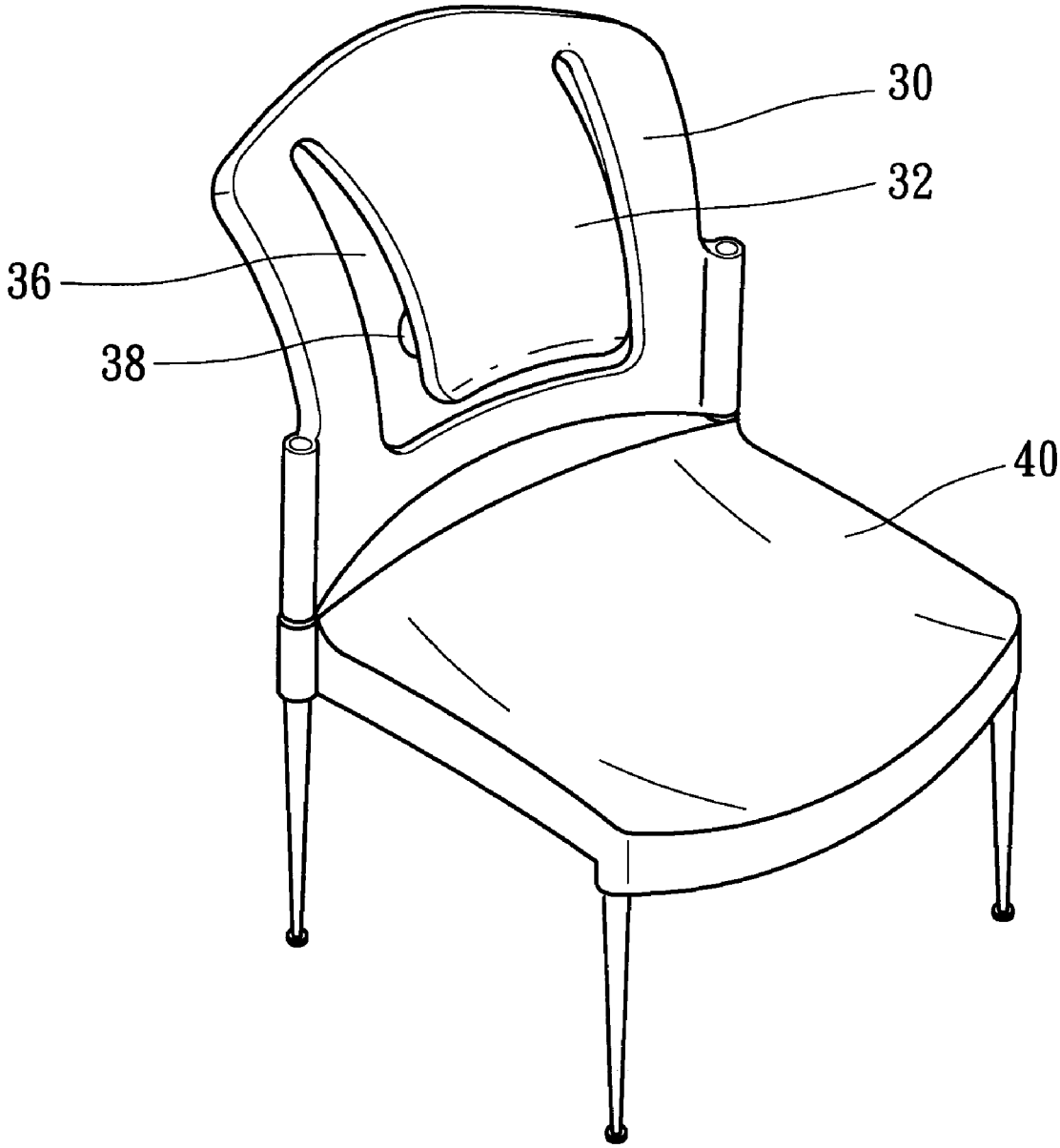
FIG. 5 shows the present invention used as the back part of a chair.
Figure 6:
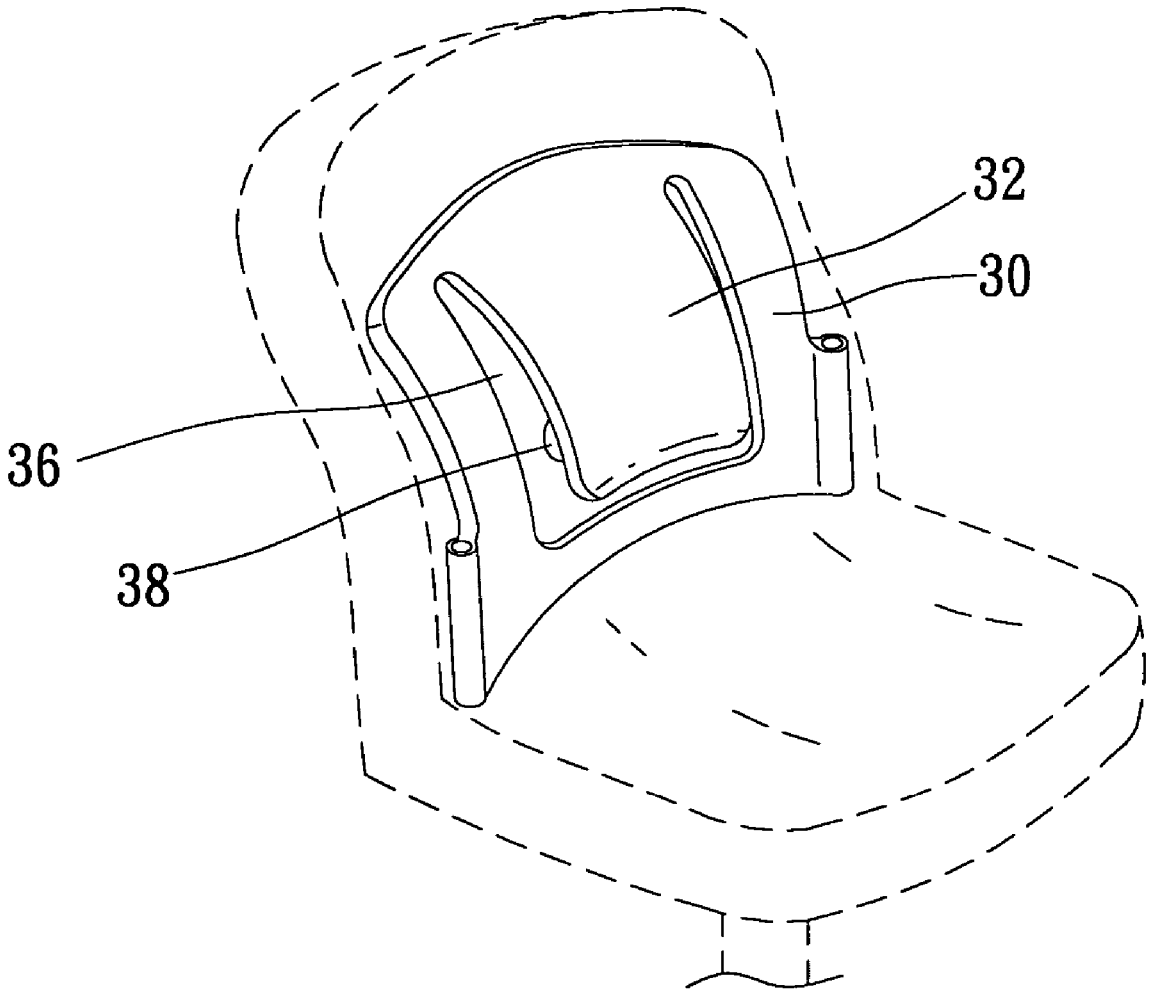
FIG. 6 shows the present invention used as an additional back supporting device in a chair.

As shown in FIG. 5, a flexible chair back thus formed is further connected with a chair seat having legs 40 to form a chair. As shown in FIG. 6, a flexible chair back is put against the chair back of a regular chair to provide an auxiliary removable back support. Therefore, the application of a flexible chair back according to the present invention can be quite flexible.

Figure 7:
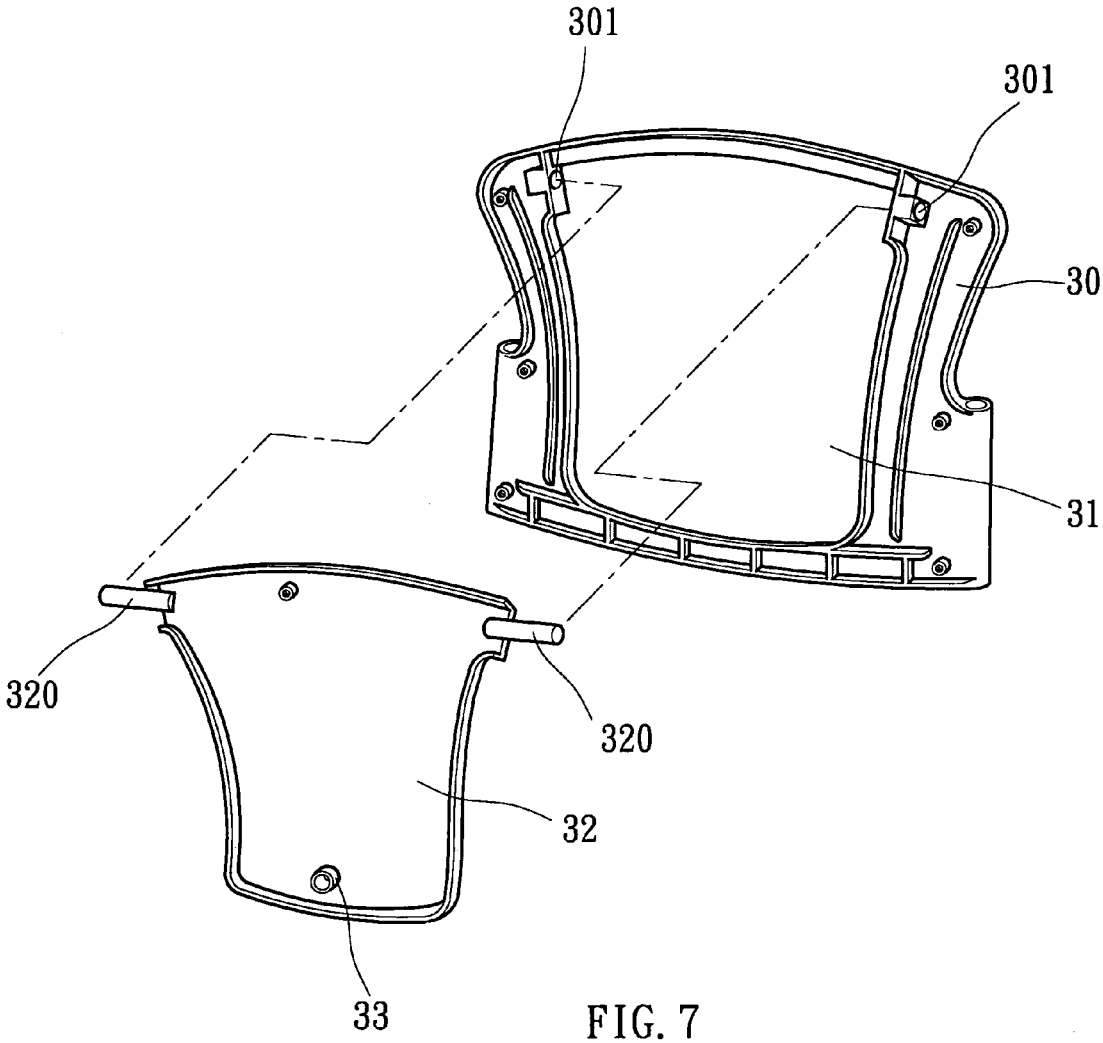
FIG. 7 is an exploded view of the second preferred embodiment of the present invention wherein a flexible member and a back supporting board are separate parts.

Furthermore, as shown in FIG. 7, a back supporting board 30 and a flexible member 32 are separate parts. The upper portion of flexible member 32 has two opposite lateral axles 320 that are pivotally connected to two corresponding axial holes 301 on the inner rim of the hollow space 31 of the back supporting board 30. To connect the back supporting board 30 and the flexible member 32, the opposite lateral axles 320 are pivotally coupled with corresponding axial holes 301, so that the flexible member 32 can rotate about an upper axis of the back supporting board 30. The means for retaining a spring 35 is the same as the first preferred embodiment, which is the spring 35 being anchored at two ends thereof respectively by a retaining post 320 on the back of the flexible member 32 and a retaining sleeve 38 on a front side of the back supporting board 30.

Accordingly, the present invention as a flexible chair back has the following advantages.

Firstly, as shown in FIGS. 3 and 4, the flexible member 32 is the first part of the back supporting board 30 a seated person touches, which provide the person with a comfort for the person's back. Furthermore, the flexible member 32 automatically pushes forward as the person's back is moving apart form the chair back slightly, so that the back can be adjusted upright. This adjusting effect allows a person to sit longer comfortably on a chair having the flexible chair back.

Secondly, as shown in FIGS. 3 and 4, the spring 35, in conjunction with the retaining post 33 and the retaining sleeve 38, enhances the elasticity of the flexible chair back, so that the plastic material making the flexible member 32 can be thin and soft. As shown in FIG. 4, the spring 35 further provides a better restoring effect as the flexible member 32 is twisted to one side caused by a seated person twisting his/her back 41. The retaining sleeve 38 further includes an inwardly inclined inner rim 380 about the opening thereof for preventing the spring 35 getting stuck by the retaining sleeve 38 caused by torsional bending of the flexible member 32.

Thirdly, the back supporting board 30 is provided with a hollow space 31 and a flexible member 32 integrally extending from the upper side of the hollow space 31. Thereby, the gap over the hollow space 31 which is uncovered by the flexible member 32 provides the necessary ventilative effect.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A flexible chair back, comprising:

a back supporting board made of plastic material provided with a hollow space and a flexible member integrally extending from an upper side of the hollow space and tilted slightly outwardly from a plane defined by the hollow space, the flexible member being provided with a hollow retaining post on an inner side thereof;

a rear board; an upper end of the rear board being directly connected to an inner side of an upper end of the back supporting board by screwing a screw into a screwing retaining hole at an upper end of the back supporting board; the rear board having a retaining sleeve of substantially cylindrical shape; the retaining sleeve being extended toward the back supporting board from an inner surface of the rear board; and a spring sandwiched by the flexible member of the back supporting board and the rear board with one end housed in the retaining sleeve and another end mounted on the retaining post;

whereby the flexible member of the back supporting board, being anchored on the spring, can provide a comfortable supporting mechanism for a seated person's back;

wherein the retaining sleeve is provided with an opening having an inwardly inclined inner rim for preventing the spring getting stuck by the retaining sleeve caused by torsional bending of the flexible member.

wherein the retaining sleeve is further provided with a lateral flange for retaining the spring more stably; and wherein the flexible member is an isolated object and has two opposite lateral axles in a top portion thereof that are pivotally connected to two corresponding axial holes on an inner rim of the hollow space of the back supporting board.

* * * * *